US008217343B2

(12) United States Patent
Cooley et al.

(10) Patent No.: US 8,217,343 B2
(45) Date of Patent: Jul. 10, 2012

(54) DEVICE AND METHOD USING MICROPLASMA ARRAY FOR IONIZING SAMPLES FOR MASS SPECTROMETRY

(75) Inventors: James Edward Cooley, San Francisco, CA (US); Viorica Lopez-Avila, Sunnyvale, CA (US); Randall Urdahl, Mountain View, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 158 days.

(21) Appl. No.: 12/693,857

(22) Filed: Jan. 26, 2010

(65) Prior Publication Data

US 2011/0180699 A1 Jul. 28, 2011

(51) Int. Cl.
*H01J 49/16* (2006.01)
*H01J 27/24* (2006.01)

(52) U.S. Cl. ..... 250/288; 250/423 P; 315/111.21; 315/111.81

(58) Field of Classification Search ..... 250/281, 250/282, 288, 423 P; 315/111.21, 111.81
See application file for complete search history.

(56) References Cited

U.S. PATENT DOCUMENTS

| | | | | |
|---|---|---|---|---|
| 3,541,372 | A * | 11/1970 | Omura et al. | 313/362.1 |
| 6,917,165 | B2 * | 7/2005 | Hopwood et al. | 315/111.21 |
| 2009/0121127 | A1 * | 5/2009 | Orlando et al. | 250/282 |
| 2009/0121638 | A1 * | 5/2009 | Price et al. | 315/111.21 |
| 2010/0019677 | A1 * | 1/2010 | Kitano et al. | 315/111.21 |
| 2010/0032559 | A1 * | 2/2010 | Lopez-Avila et al. | 250/282 |
| 2010/0327155 | A1 * | 12/2010 | Lopez-Avila et al. | 250/282 |
| 2011/0109226 | A1 * | 5/2011 | Cooley et al. | 315/111.21 |
| 2011/0175531 | A1 * | 7/2011 | Urdahl et al. | 315/111.21 |

* cited by examiner

*Primary Examiner* — Jack Berman

(57) ABSTRACT

A device includes a first substrate having a principal surface having a plurality of sample sites having a corresponding sample; a second substrate having a principal surface facing and spaced apart from the principal surface of the first substrate, the second substrate having a plurality of ultraviolet emission sites corresponding to the sample sites of the first substrate, each of the ultraviolet emission sites being spaced apart from and facing a corresponding one of the sample sites of the first substrate, each of the ultraviolet emission sites being configured to emit ultraviolet light to a corresponding one of the sample sites on the first substrate, and to ionize at least a portion of a sample provided at each sample site; and an ion extraction device configured to extract ions from a gap between the first substrate and the structure.

20 Claims, 3 Drawing Sheets

DEVICE AND METHOD USING MICROPLASMA ARRAY FOR IONIZING SAMPLES FOR MASS SPECTROMETRY

BACKGROUND

Mass spectrometry is commonly employed for determining the composition of unknown chemical samples. In a specific mass spectrometry arrangement, a sample to be analyzed is ionized, and a mass spectrometer separates the ionized sample according to the mass-to-charge ratio of the various species included in the sample to thereby determine the composition of the sample.

For efficiency, it is desirable to be able to rapidly process a number of samples.

What is needed, therefore, is an arrangement for efficient ionization of a number of samples for mass spectrometry.

SUMMARY

In an example embodiment, a device comprises: a first substrate having a principal surface comprising a plurality of sample sites each configured for having a corresponding sample provided thereat; a structure having a principal surface facing and spaced apart from the principal surface of the first substrate, the structure having a plurality of microplasma generation sites corresponding to the sample sites of the first substrate, each of the microplasma generation sites being spaced apart from and facing a corresponding one of the sample sites of the first substrate. Each of the microplasma generation sites comprising: a corresponding cavity provided in the structure and configured to receive a gas, the corresponding cavity having a cross-sectional area; a corresponding orifice having a cross-sectional area smaller than the cross-sectional area of the corresponding cavity, the corresponding orifice extending from the cavity to the principal surface of the structure; a corresponding split-ring resonator electrode having a gap in the electrode. The split-ring resonator electrode is configured to supply energy to the gas to generate a microplasma within the cavity; and an ion extraction device configured to extract ions from a gap between the first substrate and the structure.

In another example embodiment, a method comprises: providing a device, comprising: a first substrate having a principal surface comprising a plurality of sample sites each having a corresponding sample provided thereat; a structure having a principal surface facing and spaced apart from the principal surface of the first substrate, the structure having a plurality of microplasma generation sites corresponding to the sample sites of the first substrate, each of the microplasma generation sites being spaced apart from and facing a corresponding one of the sample sites of the first substrate each of the microplasma generation sites comprising: a corresponding cavity formed in the structure, the corresponding cavity having a cross-sectional area; a corresponding orifice having a cross-sectional area smaller than the cross-sectional area of the corresponding cavity, the corresponding orifice extending from the cavity to the principal surface of the structure; and a corresponding split-ring resonator electrode; and an ion extraction device; providing a gas to the cavity of a first one of the microplasma generation sites; providing a first electrode voltage to the corresponding split-ring resonator electrode of the first microplasma generation site to generate a plasma within the cavity of the first microplasma site, to emit ultraviolet light to a corresponding first sample site on the first substrate, and to ionize at least a portion of a first sample provided at the first sample site; and providing one or more extraction voltages to the ion extraction device to extract the ions of the ionized first sample from a gap between the first substrate and the structure.

In yet another example embodiment, a device includes: a first substrate having a principal surface comprising a plurality of sample sites each configured for having a corresponding sample provided thereat; a structure having a principal surface facing and spaced apart from the principal surface of the first substrate, the structure comprising a plurality of ultraviolet emission sites corresponding to the sample sites of the first substrate, each of the ultraviolet emission sites comprising a corresponding cavity having a cross-sectional area and being formed in the structure, the cavity being configured to receive a gas; and a corresponding orifice having a cross-sectional area smaller than the cross-sectional area of the corresponding cavity, the corresponding orifice extending from the cavity to the principal surface of the structure. Each of the ultraviolet emission sites is spaced apart from and faces a corresponding one of the sample sites of the first substrate, each of the ultraviolet emission sites being configured to emit ultraviolet light to a corresponding one of the sample sites on the first substrate, and to ionize at least a portion of a sample provided at each sample site; and an ion extraction device configured to extract ions from a gap between the first substrate and the structure.

BRIEF DESCRIPTION OF THE DRAWINGS

The example embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

In the following detailed description, for purposes of explanation and not limitation, example embodiments disclosing specific details are set forth in order to provide a thorough understanding of an embodiment according to the present teachings. However, it will be apparent to one having ordinary skill in the art having had the benefit of the present disclosure that other embodiments according to the present teachings that depart from the specific details disclosed herein remain within the scope of the appended claims. As used herein, "approximately" means within 10%, and "substantially" means at least 75%. As used herein, when a first structure, material, or layer is said to cover a second structure, material, or layer, this includes cases where the first structure, material, or layer substantially or completely encases or surrounds the second structure, material or layer.

Figure 1:
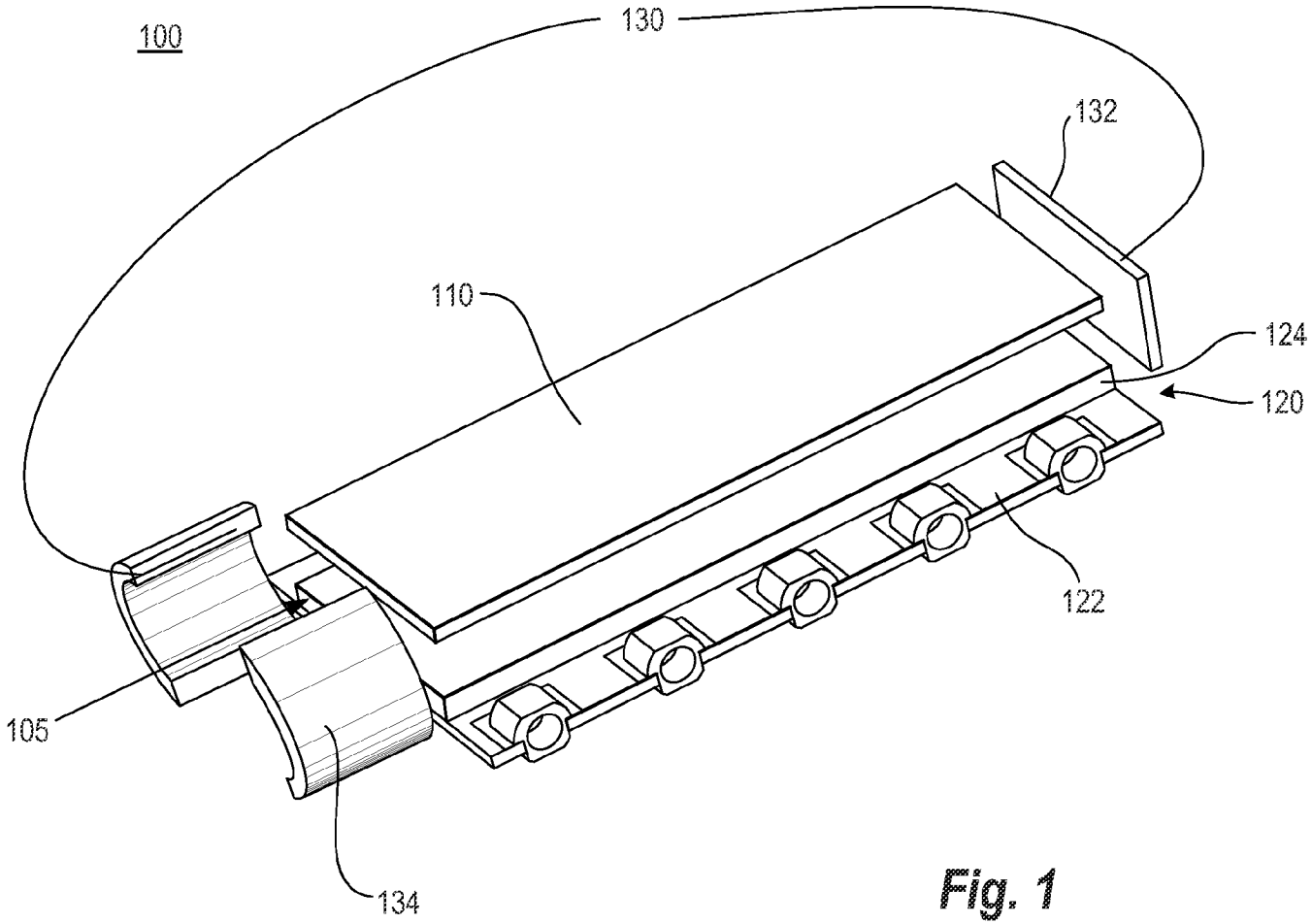
FIG. 1 illustrates one embodiment of a device including a microplasma array.

FIG. 1 illustrates one embodiment of a device 100. Device 100 includes: a first substrate 110; a structure 120 spaced apart from and confronting substrate 110, with a gap 105 therebetween; and an ion extraction device 130.

Figure 2:
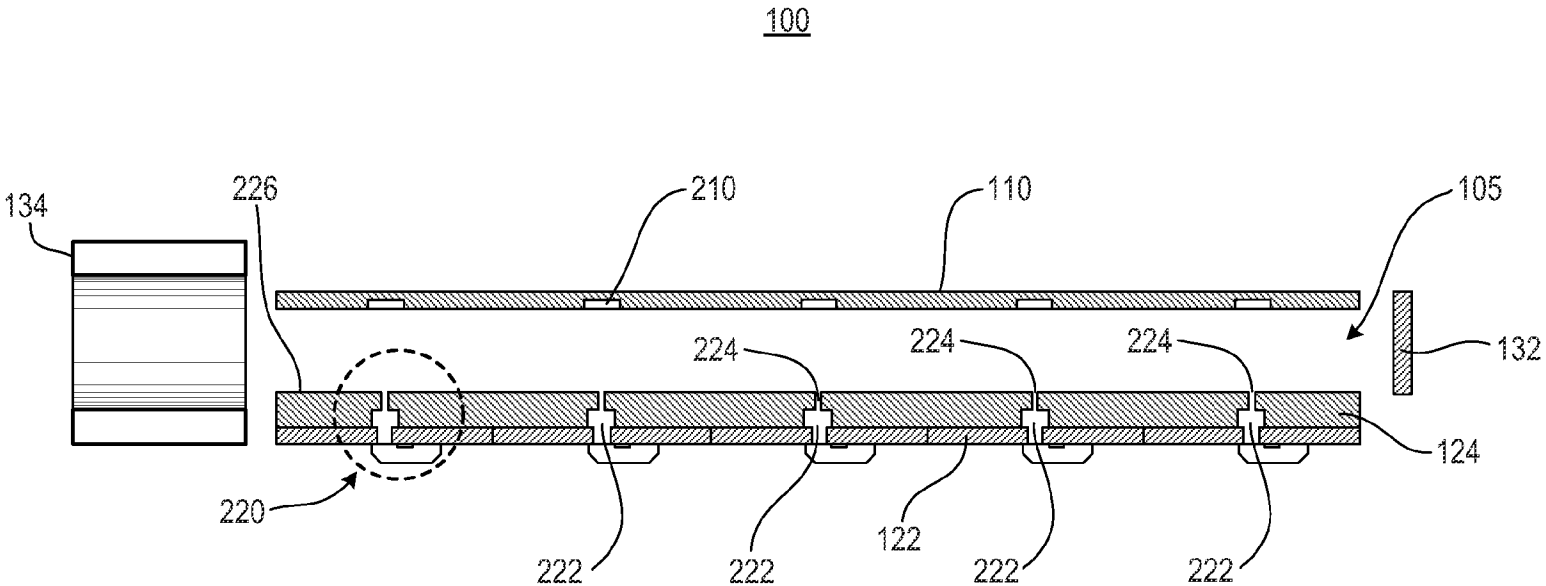
FIG. 2 illustrates a cross-section of one embodiment of a device including a microplasma array.

As will be described in greater detail below, first substrate 110 is a sample substrate having provided on a principal surface thereof one or more sample sites 210 (see. FIG. 2) having samples of material (e.g., biological or chemical samples) to be analyzed. In some embodiments, first substrate 110 may include dozens or hundreds of such sample sites 210. When first substrate 110 is provided with one or more sample materials (which may be the same as each other or different from each other) at one or more corresponding sample sites 210, then it may be referred to as a sample substrate.

Structure 120 comprises a microplasma array and includes a second substrate 122, and a third substrate 124 disposed on second substrate 122 between second substrate 122 and gap 105. Beneficially, third substrate 124 may be a ceramic substrate.

Ion extraction device 130 includes an ion repeller 132 and an ion focusing device 134.

FIG. 2 illustrates a cross-section of device 100. As shown in FIG. 2, first substrate 110 includes a plurality of sample sites 210, for example provided in a two dimensional array. Structure 120 includes a plurality of microplasma generation sites 220 each spaced apart from and facing a corresponding one of the sample sites 210 of first substrate 110. Each of the microplasma generation sites 220 comprises: a corresponding cavity 222 provided in the structure 120 (e.g., in third substrate 124) and configured to receive a gas, a corresponding orifice 224 extending from cavity 222 to the principal surface of structure 120, and a corresponding split-ring resonator see FIG. 3 below), wherein the split-ring resonator is configured to supply energy to the gas supplied to cavity 222 to generate a microplasma within cavity 222. Beneficially, the principal surface of structure 120 corresponds to the "top" surface of third substrate 124. Beneficially, an electrode (e.g., a ground plane) 226 is provided on the top surface of third substrate 124. Beneficially, orifice 224 may have a diameter of less than 1 millimeter, such as between 100-500 μm, and in particular, about 250 μm. Generally, and as depicted in FIG. 2, for example, each cavity 222 has across-sectional area and each a corresponding orifice 224 has a cross-sectional area that is smaller than the cross-sectional area of its corresponding cavity 222.

Although not shown in FIG. 2, in operation a gas supply apparatus may be connected with the structure 120 to supply gas to the cavities 222. Beneficially, the gas supply apparatus maybe be provided with a plurality of gas sources each having a different gas, and (e.g., via various valves) any one of these gases may be selectively provided to any one or more of the cavities 222 of any one or more of the microplasma generation sites 220 as desired for ionizing and analyzing one or more of the samples at the sample sites 210.

Figure 3:
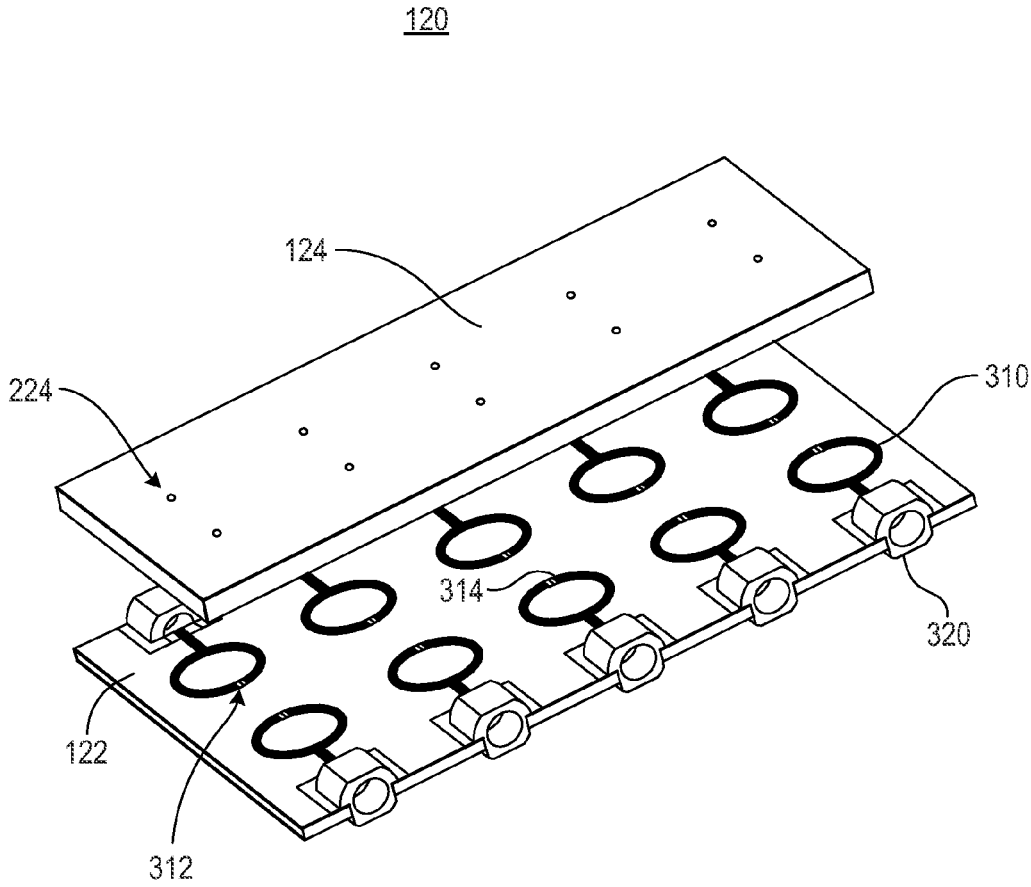
FIG. 3 illustrates an exploded view of one embodiment of a microplasma array.

FIG. 3 illustrates an exploded view of one embodiment of the structure 120 comprising a microplasma array. The structure 20 includes second substrate 122 and third substrate 124 provided thereon. At each of the microplasma generation sites 220 a split-ring resonator electrode 310 is provided for example on second substrate 122. Split-ring resonator electrode 310 has a gap 312 between the ends of the electrode 310 and is coupled to a connector 320 which supplies a signal (e.g., an RF or microwave signal) to the split-ring resonator electrode 310. Split-ring resonator electrode 310, together with a corresponding area of the electrode 226, forms a split-ring resonator for a corresponding microplasma generator site 220.

An explanation of an example operation of device 100 will now be provided.

A gas is supplied to one or more of the cavities 222 of the microplasma generation sites 220. Because of the small aperture provided by orifice 224, beneficially gas flow rates for each microplasma generation site 220 may be in a range of 1-10 cc/minute. When enemy RF or microwave energy) is provided through a connector 320 to a corresponding split-ring resonator electrode 310 of the microplasma generation site 220. The energy applied to split-ring resonator electrode 310 strikes a microplasma from the gas in cavity 222.

Orifice 224 allows light from the microplasma to exit the cavity 222 and impinge on a corresponding one of the sample sites 210 on first substrate 110. Beneficially, the light may be an ultraviolet (UV) light, and in particular, a vacuum ultraviolet (VUV) light. The light strikes a sample (e.g., a biological or chemical sample) provided at the corresponding sample site 210 and ionizes some, or all, of the sample. In some embodiments, emissions from the microplasma of microplasma generation site 220 may desorb the sample from sample site 210 of substrate 110. In other embodiments, supplemental heaters (not shown) may be employed to desorb the sample of substrate 110.

The ions from the sample are released into the gap 105 between first substrate 110 and structure 120. First and second voltages are correspondingly applied to ion repeller 132 and ion focusing device 134 to direct the ions out of the gap 105 and, for example, toward a mass spectrometer where they can be analyzed to determine a composition of the sample. For example, ion repeller 132 may be provided with a positive voltage with respect to ground, and ion focusing device 134 may be provided with a negative voltage with respect to ground. To further facilitate extraction of the ions from gap 105, some embodiments may include segmented electrodes on one or both of first substrate 110 and structure 120, and progressively increasing voltages are provided to the segmented electrodes.

Beneficially, since each microplasma generation site 220 can be individually addressed and activated by applying a desired gas to the corresponding cavity 222 and energy to the corresponding split-ring resonator, the sample materials at the sample sites 210 can be individually and selectively ionized and provided, to a mass spectrometer for example so that the sample materials can be individually and selectively analyzed one at a time.

Beneficially, energy (e.g., RF or microwave energy) may be sequentially provided to the split-ring resonator electrodes 310 of the microplasma array so that light is sequentially emitted from the microplasma generation sites 220 to the corresponding sample sites 210 so as to sequentially ionize the array of samples in the sample sites 210 for further analysis. Gas may be continuously provided to all of the cavities 222, or may be sequentially applied to the cavities 222 in synchronism with the energy being applied to the corresponding split-ring resonator electrode 310. Furthermore, different gases can be supplied to different microplasma generation sites 220, for example corresponding to a particular material to be ionized and analyzed that is disposed at the corresponding sample site 210.

Although the embodiment described in detail above employs split-ring resonators and cavities to generate an array of microdischarges, other embodiments may employ other arrangements, including DC micro-hollow-cathode discharges, and plasma display panel (PDP)-like dielectric barrier discharges.

The inventors have demonstrated that Kr microplasma gives mostly molecular ions for many small molecules that fragment extensively under electron ionization. Therefore, when the sealed structure 120 containing the second and third substrates 122 and 124 is used with a time-of-flight mass spectrometer (TOFMS), device 100 allows one to determine molecular formulas of compounds present in the samples at the sample sites 210 that are subjected to microplasma ionization mass spectrometry. This embodiment is similar to matrix-assisted laser desorption/ionization (MALDI), with a difference being that it does not require a matrix and thus can be used to ionize and analyze small molecules (MW <600 amu) by mass spectrometry.

Microplasmas, which are gas discharges that typically occupy a volume of approximately 1 cubic millimeter or less, are well-suited for use as a source of ionizing photons for a number of reasons. First, they can provide a high volumetric optical power density, allowing for efficient geometric coupling between photons and analyte flow. Second, microplasmas can be operated at very low gas flow rates, which enables windowless operation inside high-vacuum sources. Thus, not only is the problem of intensity loss over time due to window contamination eliminated, but the source is free to emit photons in the vacuum ultraviolet (VUV) range at wavelengths below about 120 nm. Third, by changing the makeup of the gas that flows to the plasma, a variety of emission wavelengths can be chosen. In particular, the rare gases (He, Ne, Ar, Kr, and Xe) can produce resonance radiation under appropriate excitation conditions. For example, He has an optical resonance line at 58.43 nm, emitting photons with energies of 21.22 eV, while Kr has resonances at 116.49 and 123.58 nm, with corresponding photon energies of 10.64 and 10.03 eV. The emission wavelength can thus be matched to the desired application: low energy photons can be used to ionize molecules without fragmenting them, whereas higher energy photons can be used to generate fragmentation spectra similar to those produced by electron impact (EI) sources. In addition, photon energies can be chosen to selectively ionize certain compounds in the presence of background gases with higher ionization potentials. Additionally, a microplasma system consumes a relatively small amount of power (on the order of 1 W), is physically compact, and can cost less than alternative means of producing VUV photons.

Potential applications of microplasma arrays include: (1) analysis of small molecules (<600 amu) that cannot be analyzed by MALDI because of interference from the MALDI matrix (i.e., sinapic acid, anthranilic/nicotinic acid, etc); (2) analysis of polar and thermally labile compounds that are separated by HPLC and then deposited directly onto the sample chip, (Note: polar compounds cannot be separated by gas chromatography because they are not volatile enough and thus require derivatization to make them volatile); (3) analysis of single compounds in crystalline form that are either solubilized in an organic solvent and then spotted onto the sample chip or deposited directly onto the sample chip in crystal form; (5) analysis of major ingredients in sample matrices such as lotions, oils, gels, TiO2 powders that are difficult to solubilize and thus cannot be handled by gas chromatography or high performance liquid chromatography (HPLC) (in this case, the plasma gas will be chosen so it will ionize only the compound of interest and not the sample matrix (i.e., 10% Kr in He was found to ionize compounds with ionization potential below 10 eV so a sample matrix consisting of petroleum hydrocarbons will not be ionized under those conditions).

When individual samples spotted onto the sample chip relate to each other i.e., samples of tissues collected from a particular organ), the mass spectral data can be used to generate an image of the concentration of compound as a function of its location in the particular tissue/organ.

While example embodiments are disclosed herein, one of ordinary skill in the art appreciates that many variations that are in accordance with the present teachings are possible and remain within the scope of the appended claims. The invention therefore is not to be restricted except within the scope of the appended claims.

The invention claimed is:

1. A device, comprising:

a first substrate having a principal surface comprising a plurality of sample sites each configured for having a corresponding sample provided thereat;

a structure having a principal surface facing and spaced apart from the principal surface of the first substrate, the structure having a plurality of microplasma generation sites corresponding to the sample sites of the first substrate, each of the microplasma generation sites being spaced apart from and facing a corresponding one of the sample sites of the first substrate, each of the microplasma generation sites comprising:

a corresponding cavity provided in the structure and configured to receive a gas, the corresponding cavity having a cross-sectional area;

a corresponding orifice having a cross-sectional area smaller than the cross-sectional area of the corresponding cavity, the corresponding orifice extending from the cavity to the principal surface of the structure;

a corresponding split-ring resonator electrode having a gap in the electrode, wherein the split-ring resonator electrode is configured to supply energy to the gas to generate a microplasma within the cavity; and an ion extraction device configured to extract ions from a gap between the first substrate and the structure.

2. The device claim 1, wherein the structure comprises:

a second substrate having the split-ring resonator electrode provided therewith; and a third substrate disposed on the second substrate and between the second substrate and the first substrate, wherein the cavities and orifices are provided in the third substrate.

3. The device of claim 2, wherein the microplasma generation sites are individually selectable one at a time so as to ionize a sample at a corresponding one of the sample sites one at a time.

4. The device of claim 1, wherein the ion extraction device comprises:

an ion repeller disposed at a first end of the first substrate and the structure; and an ion focusing device disposed at a second end of the first substrate and the structure.

5. The device of claim 4, wherein the ion repeller is provided with a first voltage, and the ion focusing device is provided with a second voltage different from the first voltage.

6. The device of claim 5, wherein the ion extraction device includes segmented electrodes on at least one of the first substrate and structure, arranged between the ion repeller and the ion focusing device, wherein the segmented electrodes are provided with progressively increasing voltages from one of the ion repeller and the ion focusing device to the other of the ion repeller and the ion focusing device.

7. A method, comprising:

providing a device, comprising:

a first substrate having a principal surface comprising a plurality of sample sites each having a corresponding sample provided thereat;

a structure having a principal surface facing and spaced apart from the principal surface of the first substrate, the structure having a plurality of microplasma generation sites corresponding to the sample sites of the first substrate, each of the microplasma generation sites being spaced apart from and facing a corresponding one of the sample sites of the first substrate, each of the microplasma generation sites comprising:

a corresponding cavity formed in the structure, the corresponding cavity having a cross-sectional area;

a corresponding orifice having a cross-sectional area smaller than the cross-sectional area of the corresponding cavity, the corresponding orifice extending from the cavity to the principal surface of the structure; and a corresponding split-ring resonator electrode; and an ion extraction device;

providing a gas to the cavity of a first one of the microplasma generation sites;

providing a first electrode voltage to the corresponding split-ring resonator electrode of the first microplasma generation site to generate a plasma within the cavity of the first microplasma site, to emit ultraviolet light to a corresponding first sample site on the first substrate, and to ionize at least a portion of a first sample provided at the first sample site; and providing one or more extraction voltages to the ion extraction device to extract the ions of the ionized first sample from a gap between the first substrate and the structure.

8. The method of claim 7, further comprising:

providing a gas to the cavity of a second one of the microplasma generation sites;

providing a second electrode voltage to the corresponding split-ring resonator electrode of the second microplasma generation site to generate a plasma within the cavity of the second microplasma site, to emit ultraviolet light to a corresponding second sample site on the first substrate, and to ionize at least a portion of a second sample provided at the second sample site; and providing the one or more extraction voltages to the ion extraction device to extract the ions of the ionized second sample from the gap between the first substrate and the structure.

9. The method of claim 8, wherein providing a gas to the cavity of the first one of the microplasma generation sites comprises selecting a first gas from among a plurality of available gases, and wherein providing a gas to the cavity of the second one of the microplasma generation sites comprises selecting a second gas from among the plurality of available gases.

10. The method of claim 7, further comprising:

providing a gas to a cavity of each of the microplasma generation sites, and sequentially providing a corresponding electrode voltage to each of the corresponding split-ring resonator electrodes of each of the microplasma generation sites to sequentially generate a plasma within each cavity, to sequentially emit ultraviolet light to a corresponding sample site on the first substrate, and to ionize at least a portion of a corresponding sample provided at the second sample site, and providing the one or more extraction voltages to the ion extraction device to sequentially extract the ions of each ionized sample from the gap between the first substrate and the structure.

11. The method of claim 7, wherein providing the one or more extraction voltages to the ion extraction device comprises:

providing a first extraction voltage to an ion repeller disposed at the first substrate and the structure; and providing a second extraction voltage to an ion focusing device disposed at the first substrate and the structure, wherein the second voltage is different from the first voltage.

12. The method of claim 7, wherein the ultraviolet light is vacuum ultraviolet light (VUV).

13. The method of claim 7, further comprising providing the extracted ions of the ionized first sample to a mass spectrometer.

14. The method of claim 7, wherein the gas includes at least one of He, Ne, Ar, Kr and Xe.

15. A device, comprising;

a first substrate having a principal surface comprising a plurality of sample sites each configured for having a corresponding sample provided thereat;

a structure having a principal surface facing and spaced apart from the principal surface of the first substrate, the structure comprising a plurality of ultraviolet emission sites corresponding to the sample sites of the first substrate, each of the ultraviolet emission sites comprising a corresponding cavity having a cross-sectional area and being formed in the structure, the cavity being configured to receive a gas; and a corresponding orifice having a cross-sectional area smaller than the cross-sectional area of the corresponding cavity, the corresponding orifice extending from the cavity to the principal surface of the structure; wherein each of the ultraviolet emission sites is spaced apart from and faces a corresponding one of the sample sites of the first substrate, each of the ultraviolet emission sites being configured to emit ultraviolet light to a corresponding one of the sample sites on the first substrate, and to ionize at least a portion of a sample provided at each sample site; and an ion extraction device configured to extract ions from a gap between the first substrate and the structure.

16. The device of claim 15, wherein each ultraviolet emission site comprises a microplasma generation site where a microplasma is generated.

17. The device of claim 15, wherein each ultraviolet emission site comprises a DC micro-hollow-cathode discharge.

18. The device of claim 15, wherein each ultraviolet emission site comprises a dielectric barrier discharge.

19. The device of claim 15, wherein each ultraviolet emission site comprises:

a corresponding split-ring resonator electrode having a gap in the electrode, wherein the split-ring resonator is configured to supply energy to the gas to generate a microplasma within the cavity.

20. The device of claim 15, wherein the ion extraction device comprises:

an ion repeller disposed at a first end of the first substrate and the structure; and an ion focusing device disposed at a second end of the first substrate and the structure opposite the first end.

* * * * *